United States Patent [19]

Johnson, Jr.

[11] Patent Number: 4,683,397

[45] Date of Patent: Jul. 28, 1987

[54] COMPACT INCANDESCENT COILED COIL FILAMENT

[75] Inventor: Pierce Johnson, Jr., Topsfield, Mass.

[73] Assignee: GTE Products Corporation, Danvers, Mass.

[21] Appl. No.: 852,010

[22] Filed: Apr. 14, 1986

[51] Int. Cl.[4] ..... H01J 1/16; H01J 19/10; H01K 1/14

[52] U.S. Cl. ..... 313/344; 315/71; 313/341; 445/48

[58] Field of Search ..... 313/341, 344, 315; 315/71; 445/35, 48

[56] References Cited

U.S. PATENT DOCUMENTS

| | | | |
|---|---|---|---|
| 2,218,345 | 10/1940 | Spaeth | 313/344 |
| 2,424,518 | 7/1947 | Stuart | 313/344 |
| 3,942,063 | 3/1976 | Winter et al. | 313/315 |
| 4,208,609 | 6/1980 | Berlec | 313/315 |
| 4,316,116 | 2/1982 | Graves et al. | 313/344 |
| 4,461,973 | 7/1984 | Kaufman et al. | 315/56 |
| 4,480,212 | 10/1984 | Monahan et al. | 315/71 |
| 4,499,401 | 2/1985 | Graves et al. | 313/315 |
| 4,547,704 | 10/1985 | Brinn et al. | 315/71 |

*Primary Examiner*—Saxfield Chatmon

*Attorney, Agent, or Firm*—José W. Jimenez; Joseph S. Romanow

[57] ABSTRACT

This invention provides an improved compact fine wire incandescent lamp filament and method for making such having a primary mandrel ratio in the range of about 1.40 to about 4.00 and a secondary mandrel ratio which is greater than or equal to the primary mandrel ratio. The improved filament design exhibits an increase in compactness and retains or increases structural rigidity while exhibiting minimal sag when the filament is incorporated into an incandescent lamp of the tungsten halogen type variety. The compact coiling method is particularly useful in designing compact filaments for high voltage applications where it is desirable to eliminate the use of rectifying means to lower the effective voltage across the filament.

14 Claims, 6 Drawing Figures

COMPACT INCANDESCENT COILED COIL FILAMENT

CROSS REFERENCES TO COPENDING APPLICATIONS

In Ser. No. 852,002, Apr. 14, 1986 entitled "AN IMPROVED REFLECTOR-TYPE LAMP HAVING REDUCED FOCUS LOSS" (Pierce Johnson) filed concurrently herewith there is described an improved reflector-type lamp having a reduction in focus loss and an improvement in reflector collection efficiency. This Application is assigned to the same assignee as the instant invention. U.S. Ser. No. 742,838, filed June 10, 1985, entitled "High Performance Filament for High Voltage Low Wattage Incandescent Lamps," assigned to the assignee hereof, contains related subject matter.

TECHNICAL FIELD

This invention relates to multiple coiled fine wire incandescent lamp filaments and lamps utilizing such filament design.

BACKGROUND OF THE INVENTION

In order to achieve improved efficiency in incandescent lamp filaments, filament design has progressed toward more compact coil configurations, starting with filament coiling as taught by Langmuir in U.S. Pat. No. 1,180,159. Coiled coil filaments as taught by Benbow in U.S. Pat. No. 1,247,068 also exhibit improved efficiency. Efforts to achieve compact coiled coil designs for the finer more resistive wires (having a diameter of 4.5 mils or less) had been limited by the need to impart rigidity to the filament by using the smallest possible mandrels for the primary and secondary coiling.

The use of coiling in filaments shortens the filament and increases its diameter. A wire of diameter D is coiled about a mandrel having a diameter M. The resulting coil is said to be compressed and is obviously shorter than the original wire and has a diameter of $D_1=2d+M$. In order to impart rigidity to the coil, it has been common coil practice to keep the diameter of the coil small. This is accomplished by keeping the mandrel ratio (M/d) as small as possible. However, a wire of diameter d cannot without special preparations be coiled about a mandrel having a diameter M which is less than d.

In U.S. Pat. No. 4,208,609 to Berlec, there is disclosed a low-power incandescent lamp having a reduction in filament squirm due to the fact that the filament has higher pitch ratios, lower mandrel ratios and is mounted under tension between the lead wires. The teaching in the Berlec Patent apply specifically to lamps of low power and having filament diameters of 1 mil or less. Triple coils have also been proposed to obtain even greater efficiency by means of an even more compact coil. However, triple coils as taught by Graves et al. in U.S. Pat. Nos. 4,316,116 and 4,449,401 have been unable to achieve sufficient rigidity to support finer, more resistant filament wires unless the mandrel ratios in either or both its secondary and tertiary coiling are less than 1. Such coils are difficult to wind and, as acknowledged by the Graves U.S. Pat. No. 4,499,401 following the description in the Graves U.S. Pat. No. 4,316,116 has lead to triple coil filaments having a flimsy structure when arranged within the incandescent lamp which causes sagging and causes the filament to ultimately experience a burn out.

Incandescent lamps of the tungsten halogen variety generally have superior performance characteristics over traditional Edison-type incandescent lamps because the former can be back-filled to very high gas pressures. This higher fill pressure retards the evaporation rate of the operating filament thus prolonging its life. However, providing lamps with long life and compact filaments is still a major problem with tungsten halogen lamps, especially with fine wire incandescent lamps. One way of extending the operating life of a filament and the incandescent lamp is to reduce the voltage across the filament by placing recitfying means, such as a diode, in series with the filament. The filament is operated at a substantially lower temperature and also at a lower efficiency in terms of lumens per watt. As an example, U.S. Pat. No. 3,869,631 by Anderson et al. teaches that an incandescent lamp having a diode in series with the tungsten filament will provide improved luminous efficacy without reducing lamp life provided the filament weight is increased approximately 50% over that ordinarily used with the particular lamp.

It is believed, therefore, that an incandescent lamp filament which achieves a high degree of compactness for the finer more resistive wires while retaining or increasing structural rigidity in an incandescent lamp would constitute an advancement in the art. In addition, a filament design which would promote smaller capsule design for high pressure halogen lamps and would provide for a simpler and less expensive mounting arrangements for the filament would constitute an even further advancement in the art.

SUMMARY OF THE INVENTION

It is an object of this invention to provide an incandescent lamp filament which achieves a greater degree of compactness while retaining or increasing structural rigidity in order to eliminate filament sag.

It is a further object of this invention to provide a filament designed for a tungsten halogen lamp which has equivalent or improved operating characteristics, including prolonged lamp life, without the need for filament supports due to the strength and compactness of the new improved filament design.

In accordance with one aspect of the present invention, there is provided an incandescent lamp comprising a hermetically sealed light transmissive envelope, means for structurally and electrically mounting a filament within the envelope, and a refractory metal coiled coil filament electrically coupled to and supported by means for mounting wherein the primary winding diameter, $D_1$and the secondary winding diameter, $D_2$, of the filament are: $D_1=d(A+2)$ and $D_2=D_1\ (B+2)$ wherein d equals the filament wire diameter and $$1.40 \leqq A \leqq 4.00 \text{ and } B \geqq A$$

such that the filament exhibits an increase in compactness and retains or exhibits an increase in structural rigidity.

In accordance with another aspect of the present invention, there is provided a method of making a coiled coil filament that exhibits an increase in compactness and retains or exhibits an increase in structural rigidity for an incandescent lamp rated at a particular wattage, voltage and efficacy, the method comprising the steps of providing a strand of fibrous filament wire having a particular length, L, and diameter, d, for a particular wattage, voltage and efficacy. The method further including the step of winding the filament wire around a primary mandrel having a diameter of $M_1$ determined by:

$$M_1 = A(d), \text{ to produce a primary coil,}$$

wherein $1.40 \leqq A \leqq 4.00$.

The primary coil is then wound around a secondary mandrel having a secondary mandrel diameter $M_2$ determined by $$M_2 = B(M_1 + 2d),$$

to produce a coiled coil configuration, where $B \geqq A$.

BEST MODE FOR CARRYING OUT THE INVENTION

For a better understanding of the present invention together with other and further objects, advantages and capabilities thereof, reference is made to the following disclosure and appended claims in conjunction with the above described drawings.

Figure 1:
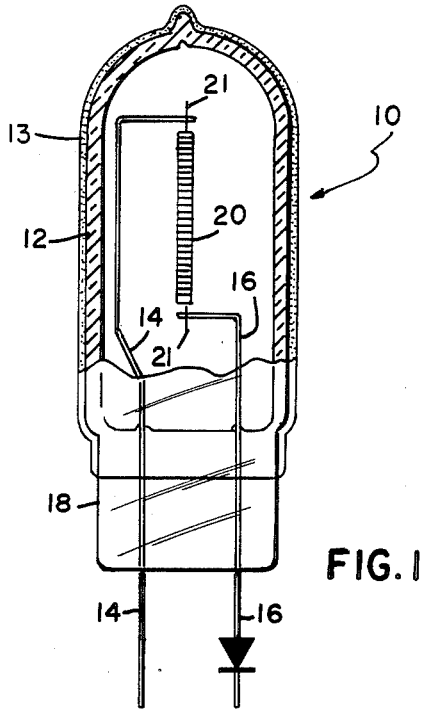
FIG. 1 illustrates one embodiment of an incandescent lamp, particularly of the tungsten halogen variety, made in accordance with the teachings of the present invention.

Referring now to the drawings with greater particularity, FIG. 1 illustrates an example of an incandescent lamp 10, in this particular embodiment being of the tungsten halogen variety, made in accordance with the teachings of the present invention. As used herein, a fine wire filament is defined to be a filament having a diameter of about 4.5 mils or less and low wattage is defined to be about 150 watts or less. The present invention provides for a coiled coil filament for incandescent lamps having improved design flexibility which is readily adaptable to a number of different envelope and lamp-type configurations. It is readily apparent that the coiled coil filament of the present invention may be used in combination with a variety of different lamp bases and envelope configurations including those of miniature and subminiature lamps.

In one embodiment of the present invention, lamp 10 has a tubular envelope 12 which may have infrared reflective coating 13 on an exterior surface thereof made of a suitable light transmissive material such as aluminosilicate glass. A pair of lead in wires 14 and 16, portions of which serve as mounting means, are press sealed in envelope 12 at press seal 18. Lead in wires 14 and 16 can be formed from molybdenum, which will form a relatively strain free hermetic seal with glass envelope 12. A refractory metal (such as tungsten) coiled coil filament 20, with legs 21, made in accordance with the teachings of the present invention, is disposed within envelope 12 and is attached to the internal ends of lead in wires 14 and 16. In this particular embodiment, envelope 12 is filled with a fill gas comprising an inert gas and a halogen or halide. Suitable examples of such an inert gas include argon or krypton or xenon and nitrogen. The halogen or halide additive, which is in the gaseous state under the heat of lamp operation or may be incorporated as part of the gaseous compound, functions to reduce the coloration of the lamp envelope.

Figure 2:
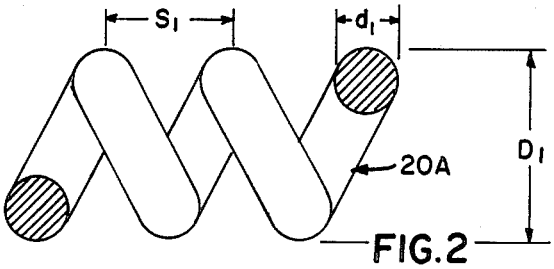
FIG. 2 illustrates a filament wire which was wound to form a coiled filament.
Figure 3:
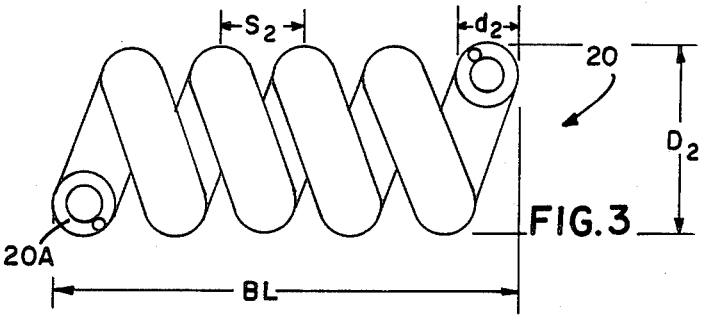
FIG. 3 illustrates a filament wire which was wound to form a coiled coil filament.

FIGS. 2 and 3 illustrate enlarged views of tungsten filament 20 and its coiled and coiled coiled stages, respectively. Each stage has a pitch or percent pitch, which is equal to S, the center to center spacing of the turns, divided by d, the diameter of the wire or coil, multiplied by 100. Specifically, FIG. 2 illustrates the primary pitch of filament 20A having a center to center spacing of $S_1$, wire diameter $d_1$ and outer diameter of $D_1$. In the present invention, the primary pitch $P_1$ is equal to $S_1/d_1$ and the secondary pitch $P_2$ is equal to $S_2/d_2$ (Note:$d_2 = D_1$) have values that do not exceed about 1.70 (or 170%). In FIG. 3, $S_2$ is the center to center spacing of the coiled coil filament, $d_2$ (Note: $d_2 = D_1$) is the primary coil diameter and BL is the body length of the coiled coil (or secondary)filament. In the preferred embodiment, the secondary pitch of the filament is in the range of about 1.40 to about 1.60.

Figure 4:
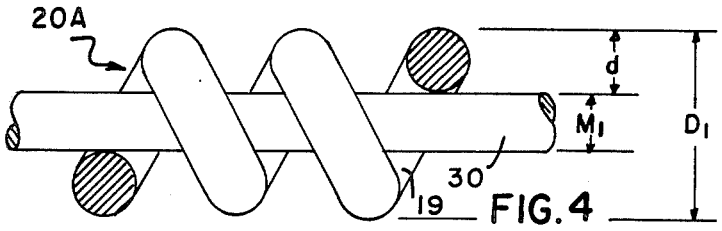
FIG. 4 illustrates a filament wire wound around a primary mandrel to form a primary coil.
Figure 5:
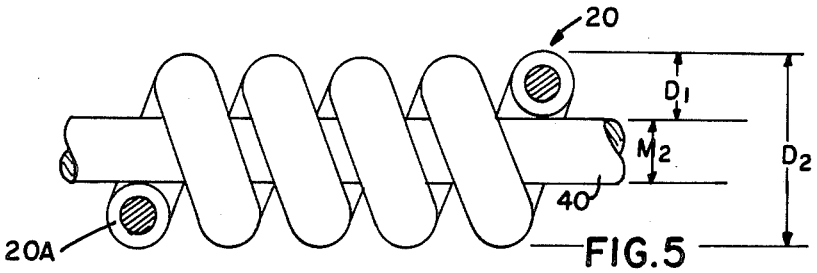
FIG. 5 illustrates a primary coil which is wound around a secondary mandrel to form the coiled coil filament.
Figure 6:
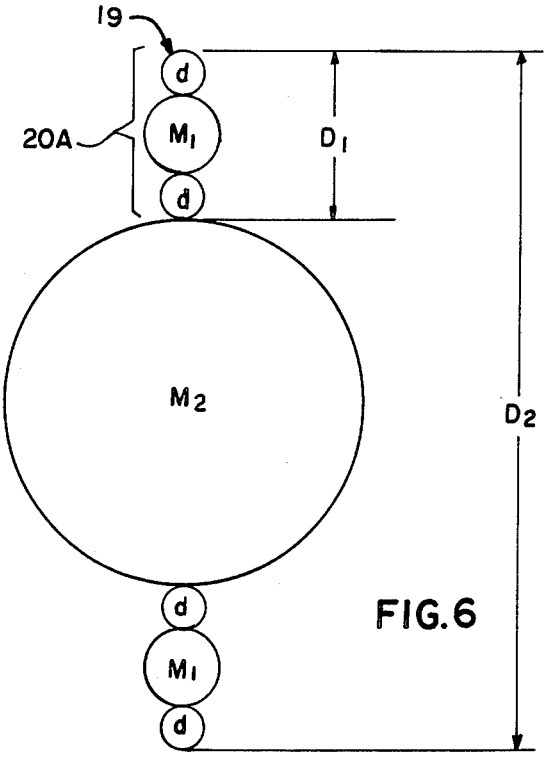
FIG. 6 illustrates the various parameters related to determining the outer diameter of a coiled coil filament of the present invention.

I have discovered, surprisingly, a method of making a coiled coil filament that exhibits an increase in compactness and retains or exhibits an increase in structural rigidity for an incandescent lamp rated at a particular wattage, voltage and efficacy. With reference to FIGS. 4–6, the method comprises the steps of providing a strand of fibrous filament wire 19 having a particular length L and diameter d for a particular wattage, voltage and efficacy and winding filament wire 19 around a primary mandrel 30 having a diameter of $M_1$ determined by: $M_1 = A(d)$, to produce a primary coil 20A as illustrated in FIG. 4, wherein the values of A are expressed by the following:

$$1.40 \leqq A \leqq 4.00.$$

Referring to FIG. 5, the method further includes the step of winding primary coil 20A around a secondary mandrel 40 having a secondary mandrel diameter of $M_2$ determined by: $M_2 = B(M_1 + 2d)$, to produce a coiled coil configuration, where $B \geqq A$. As illustrated in FIGS. 4 and 5, respectively, the primary winding diameter is equal to $D_1$ and the secondary winding diameter is equal to $D_2$. The method further includes the step of removing substantially all of the core of coiled coil filament 20 except for removing the core in legs 21 of filament 20. The core in legs 21 is preferably left intact in order to preserve the structural integrity of filament 20 when the filament is mounted within the envelope and crimped or attached by the legs to the mounting means.

With reference to FIG. 6, FIG. 6 illustrates outer diameter $D_2$ of the filament winding illustrated in FIG. 5, wherein the primary mandrel diameter $M_1$ is greater than the diameter of filament wire 19 and the secondary mandrel diameter $M_2$ is greater than the diameter of primary coil 20A. FIG. 6 should serve to illustrate that both the primary mandrel ratio, A, and secondary mandrel ratio, B, are greater than 1 and that the secondary mandrel ratio (i.e. $B=M_2/D_2$) is greater than the primary mandrel ratio (i.e. $A=M_1/d$). wherein:

$$1.40 \leqq A \leqq 4.00 \text{ and } B \geqq A.$$

To illustrate the improvement in coil or filament compactness through the use of larger mandrel ratios, particularly where the secondary mandrel ratio is greater than the primary mandrel ratio, two lamps having a visible difference in value and wattage and voltage will be used: a 105 watt lamp operated at 245 volts and a 35 watt lamp operated at 84 volts. Each example will illustrate first a filament which is wound using low mandrel ratios, which was thought to be the preferred method of developing a filament which exhibits a high degree of structural rigidity but instead the ridigity is only between supported portions of the filament. When subjected to shock, the long filaments tend to vibrate excessively. This is due in part to their length and to the fact that these filaments are heated less uniformly due to the closer or smaller inner pitch that results from small mandrel ratios. Another example will then follow of the improved method of winding the filament with the use of larger values of mandrel ratios in order to achieve a high degree of compactness, while retaining or increasing structural rigidity, and substantially eliminating, in most cases, the need for additional filament supports in an incandescent lamp.

| | SAMPLE WINDING | IMPROVED WINDING |
|---|---|---|
| 105 WATTS/245 VOLTS | | |
| STARTING WIRE | $\frac{\text{Length}}{\text{Diameter}}$ (L/d) = 22.379 | |
| PRIMARY MANDREL RATIO (A) | 1.40 | 2.00 |
| SECONDARY MANDREL RATIO (B) | 1.40 | 3.00 |
| FACTOR | 346 | 600 |
| $BL/D_2$ | 65:1 | 37:1 |
| 35 WATTS/84 VOLTS | | |
| STARTING WIRE | $\frac{\text{Length}}{\text{Diameter}}$ (L/d) = 8342 | |
| A | 1.40 | 2.00 |
| B | 1.40 | 3.00 |
| FACTOR | 346 | 600 |
| $BL/D_2$ | 24:1 | 14:1 |

where:

$$\frac{BL}{D_2} = \frac{(L/d)}{30(A+2)(B+2)} = \frac{(L/d)}{(\text{Factor})}$$

BL = Body Length $D_2$ = Outer Diameter

Referring to the 105 watt/245 volt lamp, it is noted, first of all, that such a lamp will utilize an extremely long wire of thin diameter, as exhibited by the high value obtained from the ratio of length to wire diameter (L/d), therefore, optimum winding of such a wire will be extremely important in such a lamp. In the sample winding where the mandrel ratios are low, the resulting body length (BL) to outer diameter ($D_2$) ratio is about 65:1; this results in a long flimsy filament which will ultimately require at least one or more additional filament supports to support such a filament within a small incandescent lamp envelope. The improved winding, on the other hand, utilizes larger mandrel ratios, particularly a secondary mandrel ratio that is larger than a primary mandrel ratio, which results in a body length to outer diameter ratio of about 37:1. Illustratively, the improved filament design is much more compact and, depending on the type of mounting scheme, probably would require no extra filament supports or at least less supports than in the sample winding. Referring to the 35 watt/84 volt filament example, similar results are exhibited in that in the improved winding there is a reduction in the body length to outer diameter ratio which creates a more compact filament design. In each of the above examples, compacting is achieved by greater mandrel ratios and the upper limit in the mandrel ratio values is determined by the body length (BL) of the ultimate filament design being greater than or equal to the outer diameter ($D_2$) of the resulting filament.

An incandescent lamp utilizing a filament that has a primary winding diameter $D_1$ and a secondary winding diameter $D_2$ where $D_1=d(A+2)$ and $D_2=D_1(B+2)$ wherein d is equal to the filament wire diameter and $1.40 \leqq A \leqq 4.00$ and $B \geqq A$ such that the filament exhibits an increase in compactness and retains or exhibits an increase in structural rigidity. The geometry of coiled coil filament 20 is limited by the expression $BL \geqq D_2$ wherein BL is equal to the body length of the filament. Such a limitation is utilized since having an outer diameter greater than the body length of the filament will create a filament which is although very compact will be difficult to mount properly and rigidly within a small incandescent lamp such as a tungsten halogen capsule.

With respect to variations of the present invention, the lamp in FIG. 1 may include further an outer envelope about envelope 12. The lamp of FIG. 1 may also include rectifying means electrically coupled to one of the lead-in wires, in series with the filament, and coupled to a voltage source therby reducing the voltage across the filament. The envelope of FIG. 1 also may include an infrared reflective coating such that the infrared light emitted by filament 20 is reflected back to the filament in order to increase its efficiency.

With respect to lamps operating at high voltages, especially for overseas operation at 225 and 245 volts, such lamps typically require starting off with extremely long filament wires (as illustrated earlier in the specification). Similarly, filaments designed to operate at line voltage such as 120 or 130 volts also require a long filament. The improved method for winding a filament results in a compact coil which is especially useful for these applications and can lead to enhanced operation at high voltages since typical winding techniques have lead to extremely long filaments requiring larger envelopes and more complex mounting arrangements. Furthermore, the aforementioned filament design can also lead to operation without voltage reducing or rectifying means (e.g. a diode) thereby eliminating the modulation of the light and power fluctuations that result from the use of such rectifying means. Elimination of the rectifying means is particularly important in the 225 to 245 volt range since the small filament mass leads to greater thermal fluctuations.

In the past, filament sag was reduced and compactness achieved by lowering the voltage requirement of the lamp so that a shorter, larger diameter filament wire could be used. The shorter, thicker wire has allowed for an increase in the mandrel ratios in order to achieve compactness, however transformers were now necessary to lower the line voltage. The teachings of the present invention has provided the ability to design compact high voltage filaments that lead to a simplification in fixture design and ultimately lower costs due to the elimination of a transformer (or voltage reducing means) in the fixture. The more compact filament design of the present invention will lead to an increase in structural rigidity and allows for smaller capsule design for high pressure tungsten halogen lamps of various wattage and voltage values that lead to lower capsule energy and improved containment due to possible lamp failures during lamp arc out. This leads to lower material costs for glass, fill gas, and outer jacket parts. The filament design, and method for making such, of the present invention is applicable to lower wattage lamps utilizing a hardglass envelope and may be applied to high wattage lamps utilizing high temperature materials for the envelope such as quartz. Incandescent lamp capsules resulting form the use of the more compact filaments may also be utilized with a reflector to improve collection efficiency and reduce focus loss in a reflector-type lamp.

While there have been shown what are at present considered to be preferred embodiments of the invention, it will be apparent to those skilled in the art that various changes and modifications can be made without departing from the scope of the invention as defined by the appended claims.

What is claimed is:

1. An incandescent lamp comprising:

a hermtically sealed light transmissive envelope;

means for structurally and electrically mounting a filament within said envelope; and a refractory metal coiled coil filament electrically coupled to and supported by said means for mounting wherein the primary winding diameter $D_1$ and the secondary winding diameter $D_2$ of said filament are:

$$D_1=d(A+2)$$

and $$D_2=D_1(B+2)$$

wherein:

d = the filament wire diameter $1.40 \leqq A \leqq 4.00$ $B \geqq A$ such that said filament exhibits an increase in compactness and retains or exhibits an increase in structural rigidity.

2. The lamp according to claim 1 wherein the geometry of said coiled coil filament is limited by:

$$BL \geqq D_2$$

wherein:

BL = body length of the secondary filament.

3. The lamp according to claim 1 wherein said filament has a primary pitch ratio and a secondary pitch ratio not exceeding about 1.70.

4. The lamp according to claim 3 wherein said secondary pitch of said filament is in the range of about 1.40 to about 1.60.

5. The lamp according to claim 3 wherein said means for mounting said filament is comprised of at least two lead in wires.

6. The lamp according to claim 1 wherein the wire diameter of said coiled coil filament is about 4.5 mils or less.

7. The lamp according to claim 1 wherein said lamp is a tungsten halogen lamp having a halogen or halide as part of the fill gas.

8. The lamp according to claim 7 wherein said means for mounting said filament includes a pair of lead-in wires press sealed in said envelope and extending therefrom.

9. The lamp according to claim 8 wherein said lamp furthr includes rectifyig means electrically coupled to one of said lead-in wires, in series with said filament, and coupled to a voltage source thereby reducing the voltage across said filament.

10. The lamp according to claim 7 wherein said envelope includes an infrared reflective coating such that infrared light is reflected back to said filament.

11. The lamp according to claim 1 wherein said envelope includes an infrared reflective coating such that infrared light is reflected back to said filament.

12. The lamp according to claim 1 wherein said filament is substantially coreless except for the legs of said filament.

13. A method of making a coiled coil filament that exhibits an increase in compactness and retains or exhibits an increase in structural rigidity for an incandescent lamp rated at a particular wattage, voltage and efficacy, said method comprising the steps of:

providing a strand of fibrous filament wire having a predetermined length L and diameter d for a desired wattage, voltage and efficacy;

winding said filament wire around a primary mandrel having a diameter $M_1$ determined by $M_1=A(d)$, to produce a primary coil, wherein $1.40 \leqq A \leqq 4.00$; and winding said primary coil around a secondary mandrel having a secondary mandrel diameter $M_2$ detremined by $M_2=B(M_1+2d)$, to produce a coiled coil configuration, where $B \geqq A$.

14. The method according to claim 13 wherein said method further includes the step of removing substantially all of the core of said coiled coil filament, except for the legs of said filament.

* * * * *